US006963281B2

(12) United States Patent
Buckley

(10) Patent No.: US 6,963,281 B2
(45) Date of Patent: Nov. 8, 2005

(54) TAMPER RESISTANT MAGNETIC CONTACT APPARATUS FOR SECURITY SYSTEMS

(75) Inventor: Mark C. Buckley, Shingle Springs, CA (US)

(73) Assignee: Honeywell International Inc., Morristown, NJ (US)

( * ) Notice: Subject to any disclaimer, the term of this patent is extended or adjusted under 35 U.S.C. 154(b) by 328 days.

(21) Appl. No.: 10/033,536

(22) Filed: Nov. 1, 2001

(65) Prior Publication Data

US 2003/0052780 A1 Mar. 20, 2003

Related U.S. Application Data

(60) Provisional application No. 60/323,988, filed on Sep. 14, 2001.

(51) Int. Cl.[7] ..... G08B 13/08

(52) U.S. Cl. ..... 340/547; 340/541; 340/551; 335/206

(58) Field of Search ..... 340/547, 541, 340/545.6, 551, 545.1; 335/207, 206

(56) References Cited

U.S. PATENT DOCUMENTS 4,210,889 A 7/1980 Holce
4,945,340 A * 7/1990 Brill ..... 340/547
5,233,323 A 8/1993 Burkett et al.
5,633,626 A * 5/1997 Cawthorne ..... 340/545.1
5,668,533 A 9/1997 Jackson, Jr. et al.
6,400,267 B1 * 6/2002 Gordon-Levitt et al. .... 340/547

OTHER PUBLICATIONS

Invitation to pay additional fees with Annex (Partial International Search); PCT/US02/29096; mailed Jan. 24, 2003.

* cited by examiner

*Primary Examiner*—Anh V. La
(74) *Attorney, Agent, or Firm*—John P. O'Banion

(57) ABSTRACT

A tamper resistant magnetic contact switch apparatus for alarm systems that has a plurality of magnetic reed switches configured in a logic circuit and a magnetic pack for actuation. A magnetic shield disposed around the switches defines an actuation zone. In combination with the magnetic shield preventing magnetic fields from reaching the switches from locations outside the actuation zone, the magnet pack activates two of the five switches when positioned within the actuation zone to complete the logic circuit. The magnet pack does not, however, activate any of the other switches. If any of the other three switches are activated, or if either of the two activated switches are deactivated, the logic circuit is broken and the alarm circuit is activated.

49 Claims, 10 Drawing Sheets

TAMPER RESISTANT MAGNETIC CONTACT APPARATUS FOR SECURITY SYSTEMS

CROSS-REFERENCE TO RELATED APPLICATIONS

This application claims priority from U.S. provisional application Ser. No. 60/323,988 filed on Sep. 14, 2001, incorporated herein by reference.

STATEMENT REGARDING FEDERALLY SPONSORED RESEARCH OR DEVELOPMENT

Not Applicable

REFERENCE TO A COMPUTER PROGRAM APPENDIX

Not Applicable

BACKGROUND OF THE INVENTION

1. Field of the Invention

This invention relates generally to high security, tamper resistant contact systems and more particularly to a logic circuit including magnetically actuated sensors that are resistant to foreign magnetic fields and that do not require custom tuning for monitoring door or window openings or the like as part of an electrically monitored physical security system.

2. Description of the Background Art

Thieves and intruders of increasing sophistication continue to challenge the peaceful security of businesses and homes alike. Because security personnel cannot be present at all potential points of entry to a structure, effective security systems require accurate indicators of the movement of doors and windows and other points of entry. Similarly, safety control systems on industrial machinery require accurate indicators as to whether a safety guard or cover is in place before activating or deactivating the machine.

Magnetically actuated proximity switches known in the art typically have one or more reed switches mounted to a frame surrounding a window or doorway that are electrically connected to the security control unit. One or more permanent magnets are mounted to a door or window in predetermined positions. When the permanent actuating magnet is brought in proximity to the reed switch, as determined by the sensitivity of the reed switch and the strength of the permanent magnet, the reed switch is actuated by the permanent magnet by closing a set of magnetic contacts within the switch and completing the circuit. A signal is thereby sent to the control unit indicating that the door is in proper position.

One deficiency with conventional magnetic proximity switches is that the permanent actuating magnets must be precisely positioned with respect to the reed switch, thereby requiring periodic adjustments to avoid false alarms or an ineffective system. Consequently, regular adjustments must be made as a result of seasonal changes in temperature and humidity, as well as frequent use of the door or window that may lead to misalignment of the permanent magnet and switch. Misalignment may result in false alarms as well as unscheduled service calls for manual realignment of the switch or magnet.

It is therefore desirable to use a fairly sensitive switch so that the device has a greater tolerance to small deviations in the position of the permanent actuating magnets and the switch without setting off a false alarm. Sensitivity of the reed switches has been improved in the art by the placement of small biasing magnets near the reed switch to bias the response of the switch to external magnetic fields. The biasing magnet may be oriented in polar opposition to the actuating magnet thereby increasing the sensitivity of the reed switch. Thus, smaller and less expensive magnets may be used as actuating magnets.

Another deficiency of conventional magnetically actuated proximity switches is that they may be subject to circumvention or manipulation by strong foreign magnetic fields. For example, a conventional magnetic switch can be defeated by the placement of an external magnet near the switch. A magnet may be used to defeat a conventional magnetic switch on the opposite side of the door if it produces a sufficient magnetic field. The intruder can open the door without activating the alarm because the strong external magnetic field caused the switch to stay in the same state as when the actuating magnets are in the proper position.

Later "balanced" type switches were developed that may be sensitive to externally applied magnetic fields. One approach to solving the aforementioned deficiencies can found in U.S. Pat. No. 4,945,340 to Brill, incorporated herein by reference. The Brill patent discloses an apparatus comprising three switches, two of which are responsively adapted to a fixed magnetic field placed in proximity to the switches. The third switch is positioned to detect when another magnetic field, introduced by someone who is attempting to defeat the security system, is placed in proximity to the three switches and the fixed magnetic field. One apparent deficiency of the Brill approach, however, is that the third switch fails to detect when another magnetic field of the same form produced by the magnet pack assembly described therein is placed in proximity to the three switches. Therefore, Brill's approach is easily compromised by anyone placing another like fixed magnetic field in proximity to the three switches and thereby disabling the security system.

Magnetically biased high security switches also have disadvantages due to changes in the magnetic strength of the biasing magnets. For example, due to their inherent sensitivity, they may malfunction and cause false alarms. Accordingly, the switches and magnets must be carefully adjusted and positioned during installation to avoid false alarms. Furthermore, magnetically balanced switches are difficult to manufacture and are costly because the magnets must be magnetically balanced very carefully, either during installation, or preset at the factory.

Therefore there is a need for a switch apparatus that cannot be compromised by the placement of an additional magnetic field placed in proximity to the apparatus for the purpose of defeating the security system. There is also a need for an apparatus that will detect the presence of an additional magnetic field in proximity to the apparatus. There is also a need for a switch apparatus that will enter into an alarm state when an additional magnetic field is placed in proximity to the apparatus. There is also a need for a switch apparatus that can be precisely assembled and obviates the need to perform adjustments at the factory. The present invention satisfies these needs, as well as others, and generally overcomes the deficiencies found in existing equipment.

BRIEF SUMMARY OF THE INVENTION

The present invention is an apparatus for use in a physical security-monitoring environment to activate an alarm circuit. In general terms, the apparatus comprises a plurality of magnetic reed switches configured in a logic circuit and a magnetic pack for actuation. A magnetic shield disposed around the switches defines an actuation zone. In combination with the magnetic shield preventing magnetic fields from reaching the switches from locations outside the actuation zone, the magnet pack activates two of the five switches when positioned within the actuation zone to complete the logic circuit. The magnet pack does not, however, activate any of the other switches. If any of the other three switches are activated, or if either of the two activated switches are deactivated, the logic circuit is broken and the alarm circuit is activated.

By way of example, and not of limitation, the apparatus includes a sensor unit, having a common conductor, a guard conductor and preferably at least five switches, and an actuator unit associated with the sensor unit. Each of the switches is adapted to be placed in an activated state in response to exposure to a magnetic field of predetermined magnetic flux.

The sensor unit also includes a logic circuit electrically interconnecting the switches and the common and guard conductors, the logic circuit completing a series circuit between the common conductor and the guard conductor whenever at least two predetermined switches are in a magnetically actuated condition.

The associated actuator unit includes at least two permanent magnets and provides discrete magnetic fields of predetermined flux density and position sufficient to activate the two or more predetermined switches individually to complete the series circuit between the common conductor and the guard conductor when the actuator unit is located in predetermined position with respect to the sensor unit.

The series circuit is interrupted and a shunt circuit to an alarm conductor is completed whenever the actuator unit is removed or an additional magnetic field is placed in proximity to the sensor unit switches.

Preferably, the sensor unit and the actuator unit each include a sealed protective nonmagnetic housing. The sensor unit further includes a magnetically permeable shield in which the switches are disposed.

In one embodiment, the sensor unit includes five switches and the actuator unit includes two permanent magnets, each permanent magnet being positioned to activate a corresponding switch such that only two of the five switches are activated to complete the series circuit between the common conductor and the guard conductor when the actuator unit is located in its predetermined position. In that embodiment, each switch is a single-pole-double-throw (SPDT) reed switch and the logic circuit includes a printed circuit board on which the reed switches are mounted. Three of the switches are placed in a row along the length of the sensor unit, and the switches at both ends of the row are activated when the actuator unit is located in its predetermined juxtaposition. One switch is placed in parallel to each switch located at both ends of the row respectively and is not activated when the actuator unit is located in its predetermined position. Two permanent magnets are poles so that the middle switch remains in a deactivated state.

The apparatus includes an arrangement of switch elements and logic circuitry that will interrupt a guard circuit when it is disturbed by the presence of a foreign magnetic field. The switch units of the logic circuit and the magnets of the actuator unit are spaced apart in a coordinated array so that the flux pattern from the cooperating magnetic actuator will only actuate specific switch units.

One embodiment also includes a pry tamper system that has a wall-mounted magnet and a reed switch assembly positioned above the wall-mounted magnet. The reed switch is preferably placed in proximity to a window in the magnetic shield to allow the magnetic flux of the permanent magnet to reach the reed switch. An attempt to pry and separate the sensor unit from the actuation unit will activate the alarm.

An object of the invention is to provide a magnetic contact apparatus that cannot be compromised by the introduction of an additional magnetic field placed in proximity to the system for the purpose of defeating the system.

Another object of the invention is to provide a magnetic contact apparatus that will detect the presence of an additional magnetic field placed in proximity to the security system.

Still another object of the invention is to provide a magnetic contact apparatus that will enter into an alarm state when an additional magnetic field is placed in proximity to the security system.

A further object of the invention is to provide an alarm contact apparatus that can detect tampering or the removal of the contact from its original position of installation.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings that are for illustrative purposes only.

DETAILED DESCRIPTION OF THE INVENTION

Referring more specifically to the drawings, for illustrative purposes the present invention is embodied in the apparatus generally shown in FIG. 1 through FIG. 10 wherein like references denote like parts. It will be appreciated that the apparatus may vary as to configuration and as to details of the parts without departing from the basic concepts as disclosed herein.

Figure 1:
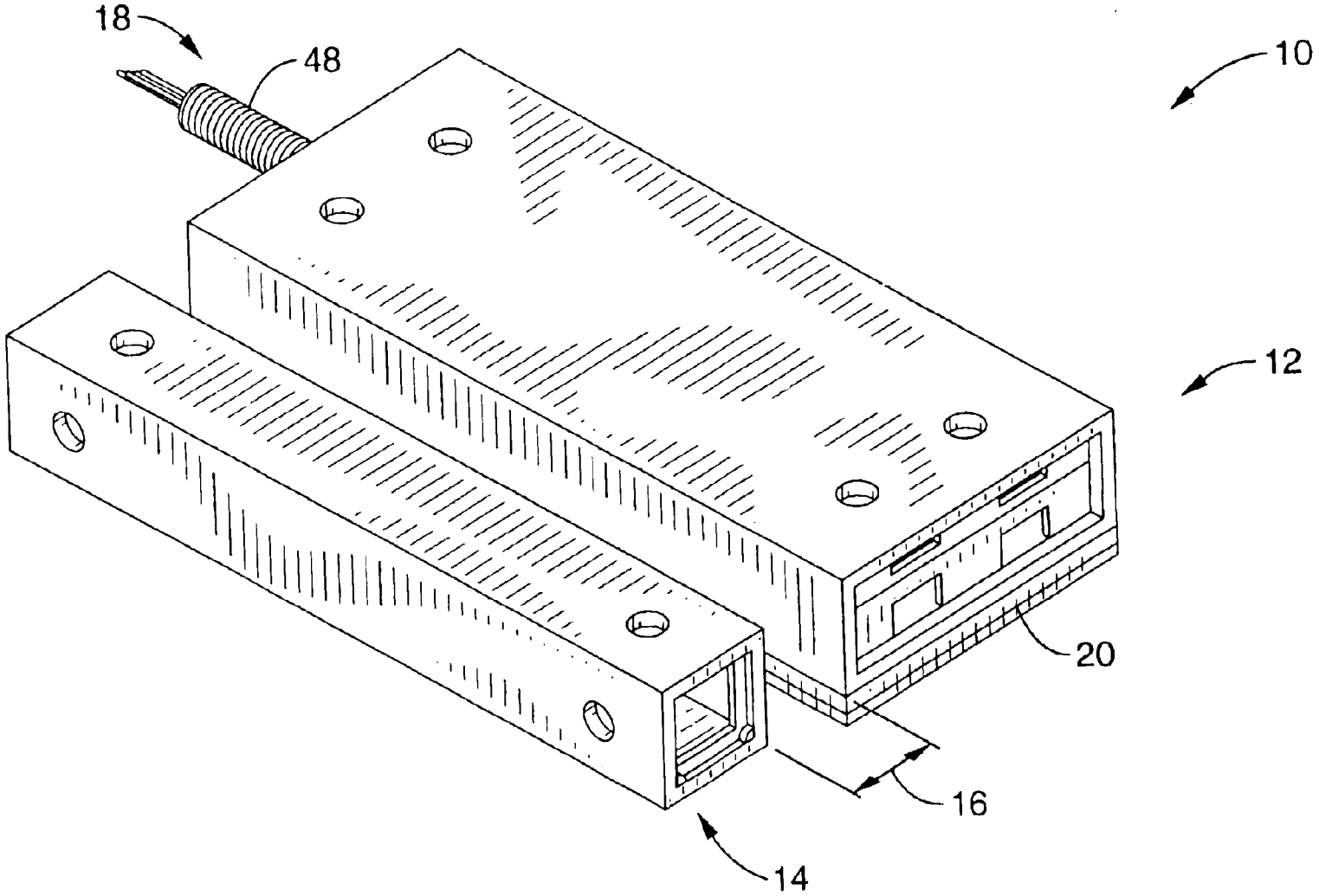
FIG. 1 is a perspective view of a sensor unit and an actuator unit in accordance with the present invention.

Referring now to FIG. 1, the high security alarm sensor apparatus 10 of the present invention is generally shown. The apparatus has a sensor unit 12 and a cooperating actuator unit 14, each of which is mounted in a predetermined position with respect to each other on points of entry to a building such as a door or window. The sensor unit 12 has an armored alarm control cable 18 that is preferably electrically connected to a central alarm control panel (not shown). It will be seen that whenever the actuator unit 14 is placed in the proper proximity 16 to the sensor unit 12, the sensor unit remains in a guarded condition. If the actuator unit is removed from the proximity of the sensor unit 12, or if an additional magnetic field is placed in proximity to the sensor unit 12, the sensor unit will enter into an alarm condition.

Figure 2:
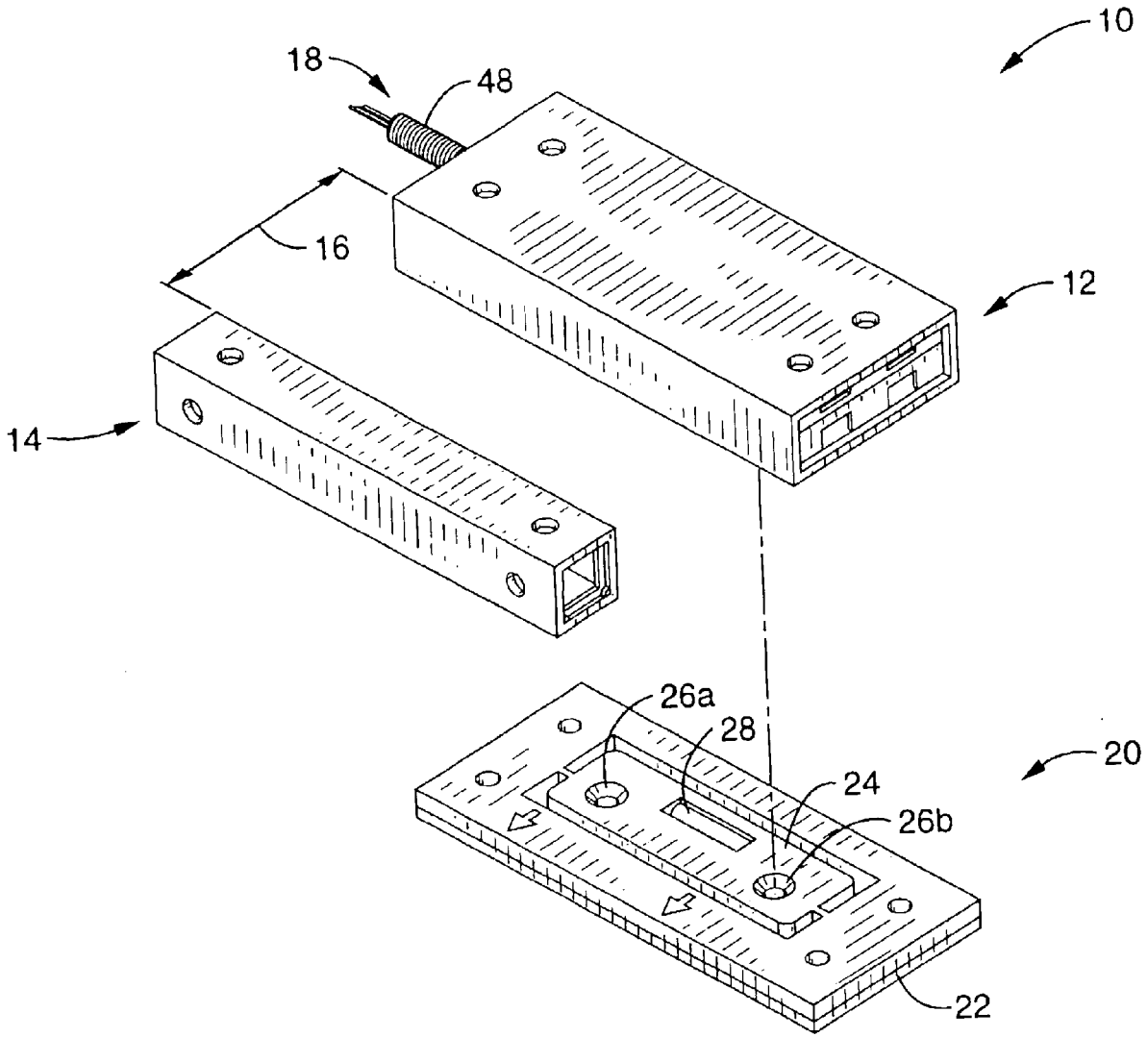
FIG. 2 is a perspective view of the sensor unit, the actuator unit and the tamper plate in accordance with the present invention.
Figure 3:
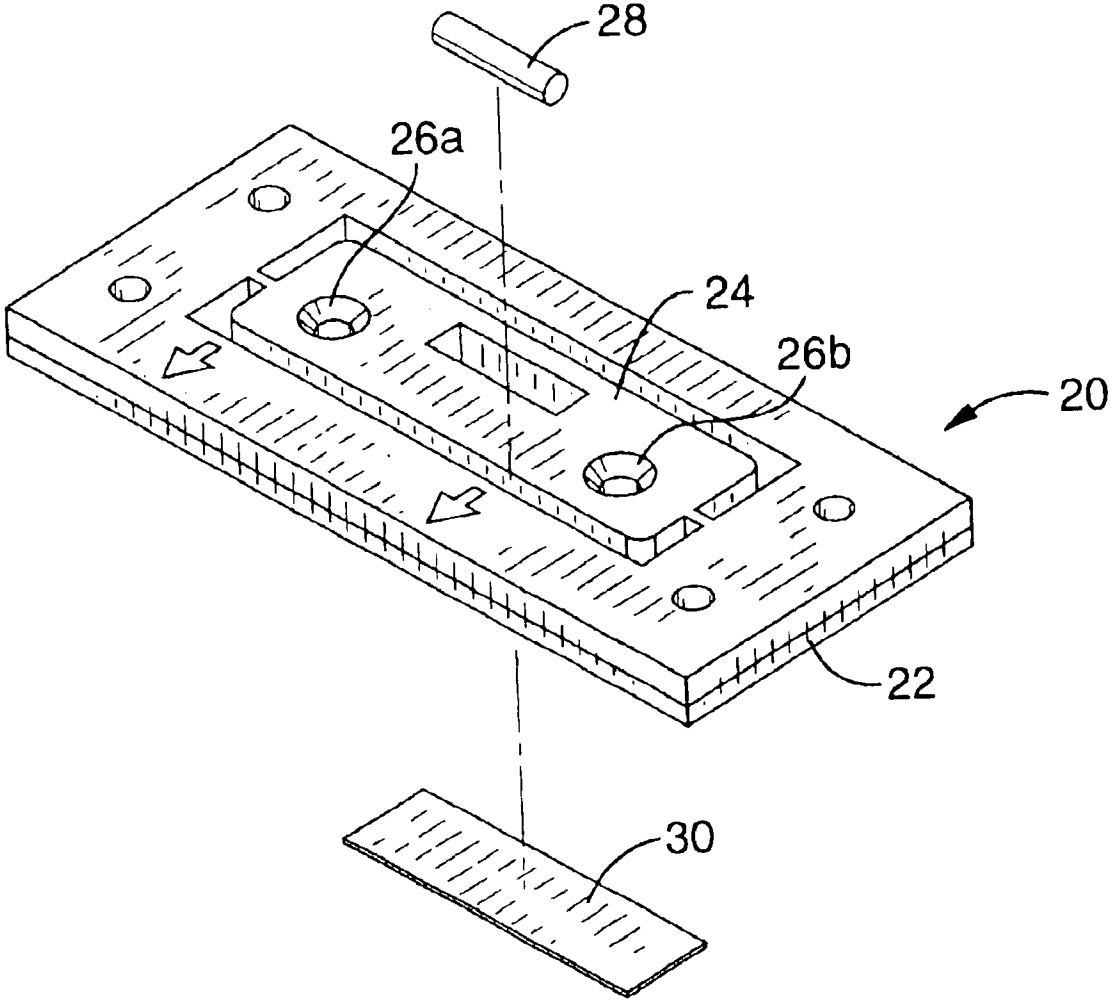
FIG. 3 is an exploded perspective view of the tamper plate shown in FIG. 2.

In one embodiment, a tamper plate 20 is coupled with the sensor unit 12 as seen in FIG. 1 and FIG. 2. Referring also to FIG. 3, the tamper plate 20 is affixed to the desired location with screws or other fasteners disposed in mounting holes 26*a* and 26*b* located at the center section 24 of the tamper plate 20. The sensor assembly 12 is mounted to the peripheral section 22 of tamper plate 20. Tamper plate 20 is preferably manufactured from a strong material such as ABS plastic. Accordingly, any attempt by an intruder to pry the sensor unit 12 from its installed location will result in the separation of the central section 24 from the peripheral section 22 of tamper plate 20 leaving central section 24 in its original location.

A permanent magnet 28 is preferably disposed in a slot in the central section 24 of tamper plate 20. In one embodiment, the magnetic field of permanent magnet 28 is shielded with a magnetic shield 30. The tamper plate magnetic shield 30 is preferably made from zinc-plated steel that will permit an essentially constant magnetic field regardless of the nature of the mounting surface such as wood or steel.

Figure 4:
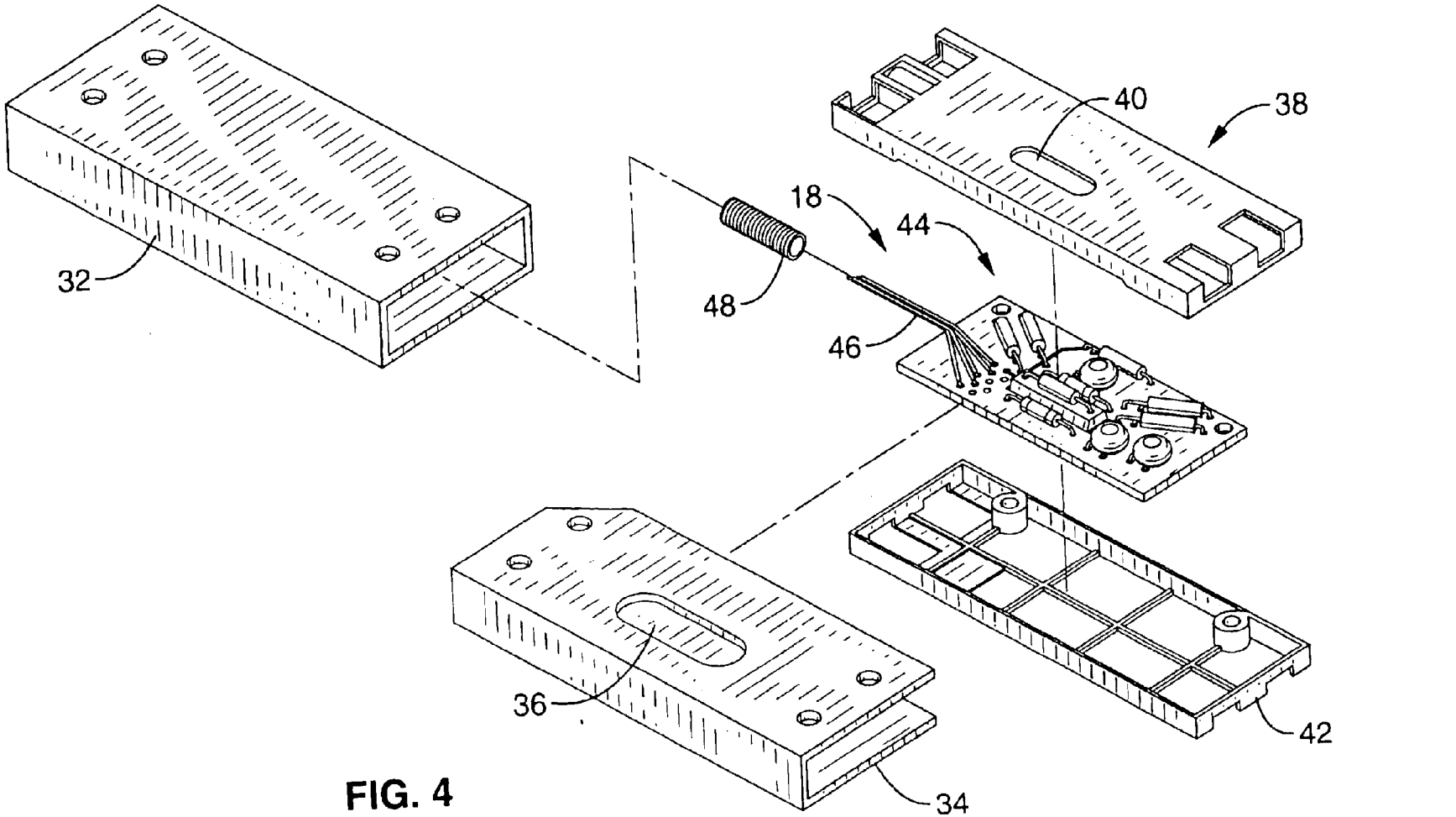
FIG. 4 is an exploded back view in perspective of the sensor unit shown in FIG. 2.

Referring now to FIG. 4, the preferred components of the sensor unit 12 of the invention can be seen. The sensor unit 12 preferably has an outer housing 32 made of anodized aluminum or similar material. Sensor unit 12 preferably has a printed circuit board assembly 44 that is held in place within an upper and lower printed circuit board holders 38 and 42 respectively. Upper and lower board holders 38 and 42 preferably enclose the printed circuit board 44 and permit access of alarm control cable 18 comprising a wire bundle 46 and an armored cable sheath 48. Armored cable sheath 48 is preferably stainless steel flex cable or the like that is commercially available.

Board 44, upper holder 38 and lower holder 42 are disposed in a generally "C" shaped sensor magnetic shield 34. Magnetic shield 34 is preferably made from zinc-plated steel or like material to shield the circuit board from external magnetic fields. Shield 34 is configured to be contained within outer housing 32.

Figure 5:
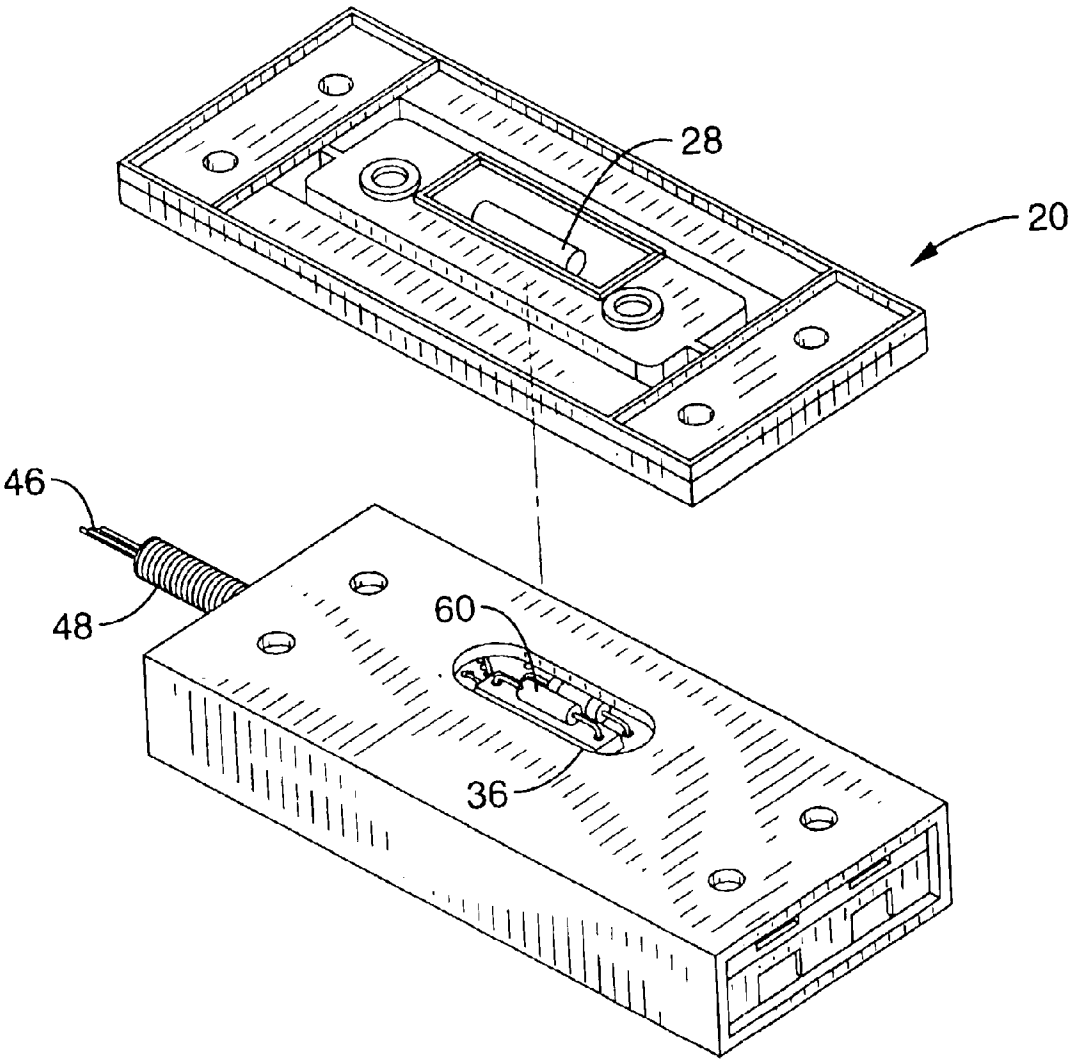
FIG. 5 is a back view in perspective of the sensor unit and the tamper plate in accordance with the present invention as shown in FIG. 2.
Figure 9:
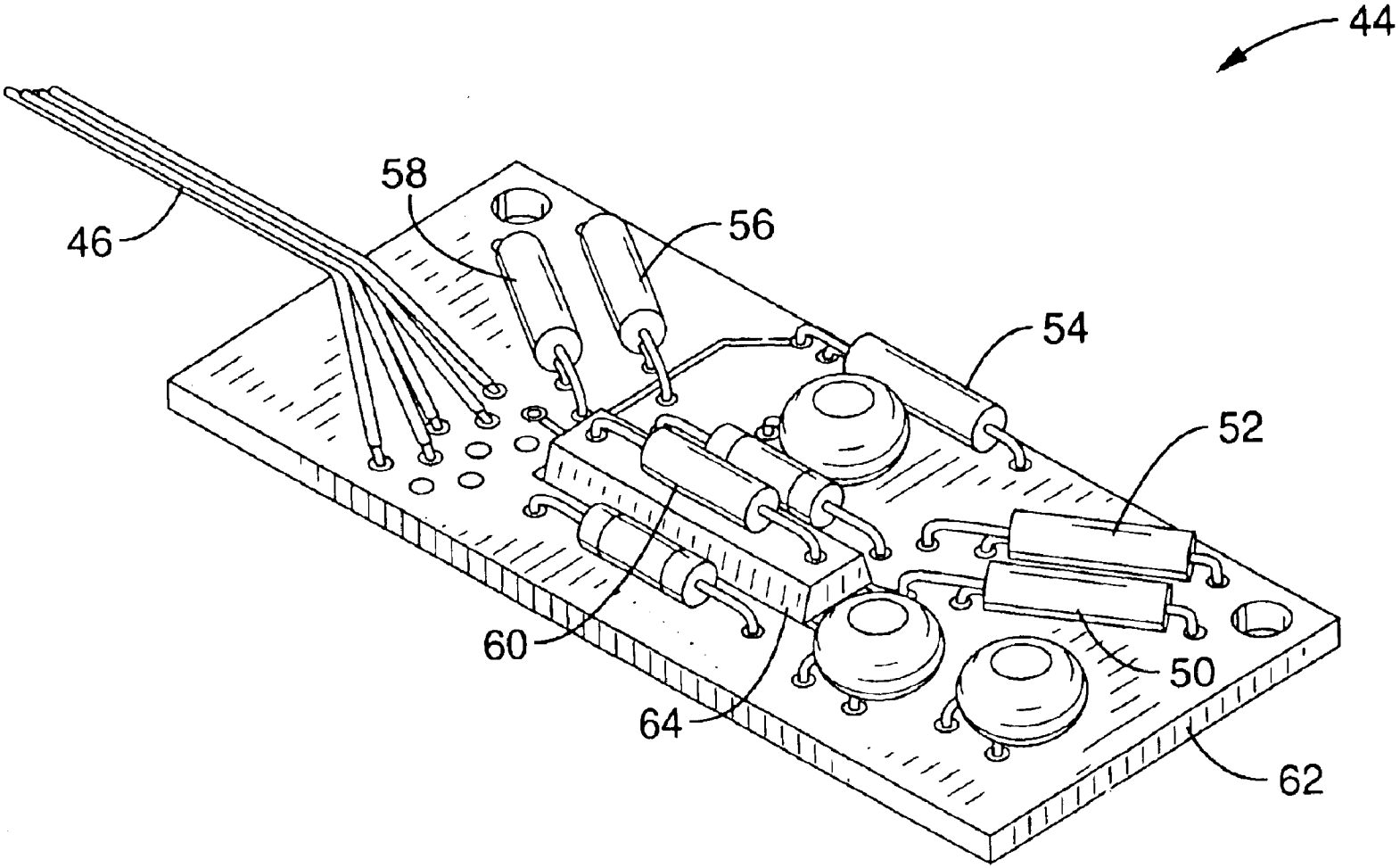
FIG. 9 is a perspective side view of the sensor unit printed circuit board shown in FIG. 4 rotated 90 degrees about the long axis.

Upper holder 38 and lower holder 42 are preferably made of ABS plastic or like material and precisely hold circuit board 44 in a predetermined position within the housing 32. A slot 40 is located on the upper holder 38 above one of the reed switches 60 of the printed circuit board 44. A corresponding slot 36 is preferably located in the magnetic shield 34. Referring also to FIG. 5, it can be seen that permanent magnet 28 of tamper plate 20 is positioned over the slot 36 of magnetic shield 34 and slot 40 of the upper holder 38 and tamper reed switch 60 on the printed circuit board 44. Tamper reed switch 60 may be raised from the plane of the surface of printed circuit board 44 with a tamper switch mount 64 as seen in FIG. 9.

Accordingly, when tamper plate 20 is mounted with sensor assembly 12, the magnetic field of wall mounted magnet 28 can reach the tamper reed switch 60 through the slots but the magnetic field does not reach any of the other reed switches located on printed circuit board 44. When reed switch 60 is within the magnetic field of magnet 28 the system is normal. However, if an intruder attempts to remove the sensor assembly 12 that has been installed with the tamper plate 20, the outer section 22 of the plate will remain with the sensor housing 32 while the central section 24 with magnet 28 will remain fixed to the wall. The magnetic field of magnet 28 will thereby be removed from the proximity of reed switch 60 and an alarm will be activated.

Figure 6:
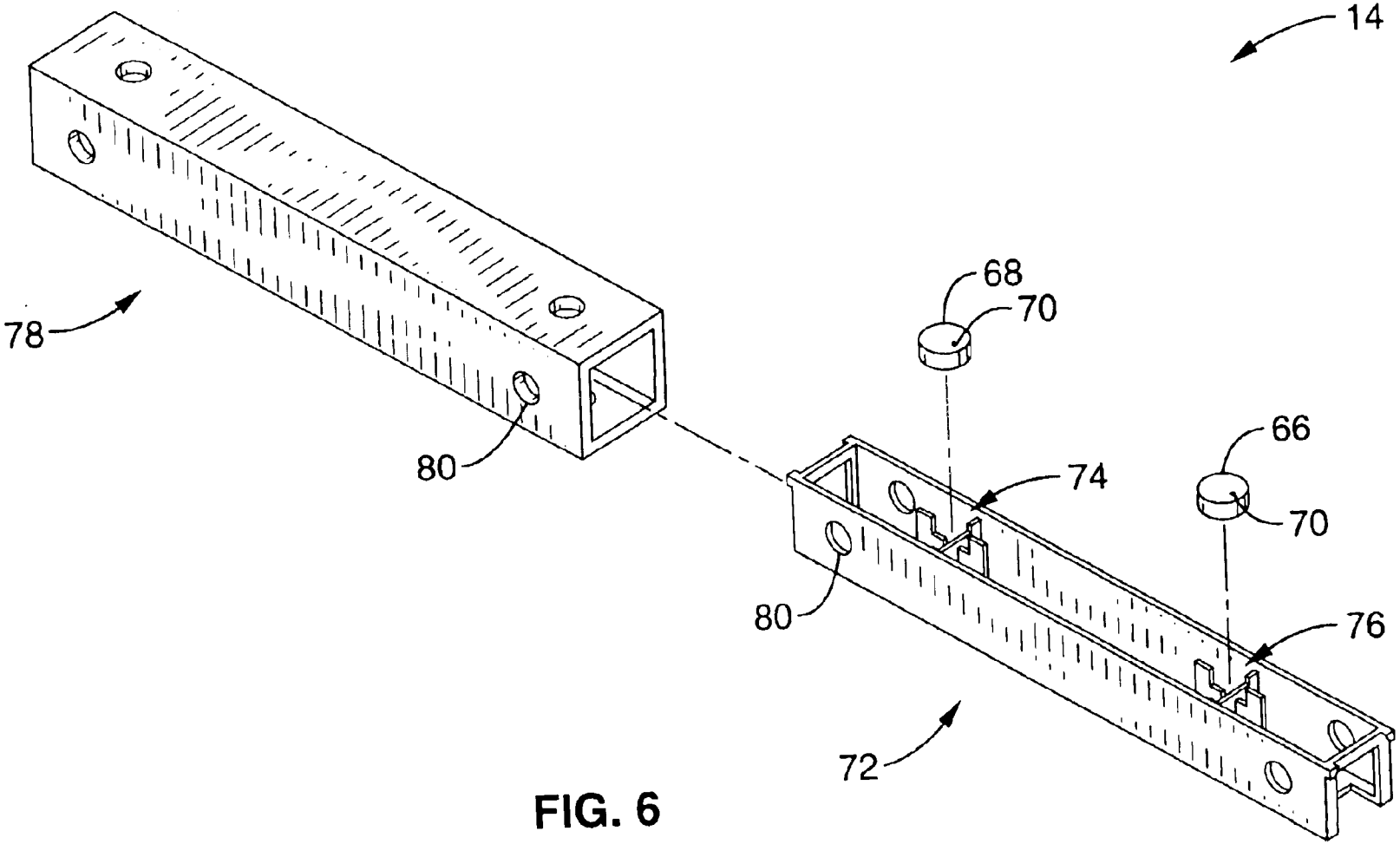
FIG. 6 is an exploded perspective view of the actuator unit shown in FIG. 1 and FIG. 2.

Turning now to FIG. 6, the preferred configuration of the actuator unit 14 can be seen. The actuator unit 14 preferably has a pair of permanent magnets 66 and 68 that are held in the proper position by magnet holder 72. Optionally, the north pole of the magnets 66, 68 may be marked with a mark 70 to indicate the polarity of the magnets.

In the embodiment shown, magnet holder 72 has retaining brackets 74 and 76 that are configured to precisely position the magnets 66, 68 and their magnetic fields. Magnet holder 72 is preferably made of ABS plastic and is dimensioned to fit within actuator housing 78. Magnet housing 78 is preferably made of anodized aluminum. In one embodiment, holes 80 are preferably drilled after potting.

In one embodiment, each magnet 66 and 68 is composed of neodymium-iron-boron that preferably has a coercive force of about 12,000 oresteds, a diameter of about 1.3 centimeters and a height of about 0.6 centimeters.

Figure 7:
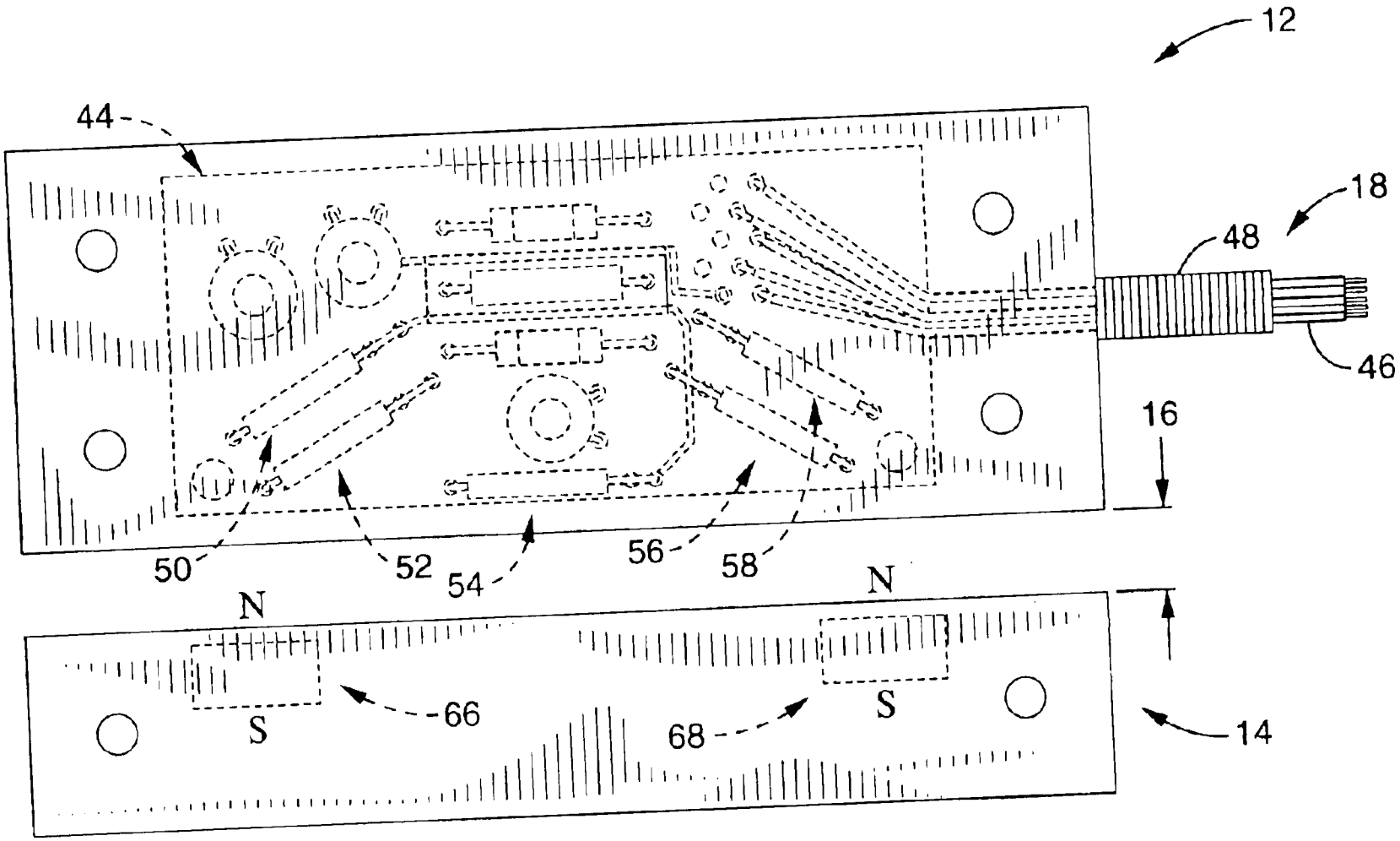
FIG. 7 is a top view of the sensor unit printed circuit board in proximity to the actuation unit and magnet positions.
Figure 8:
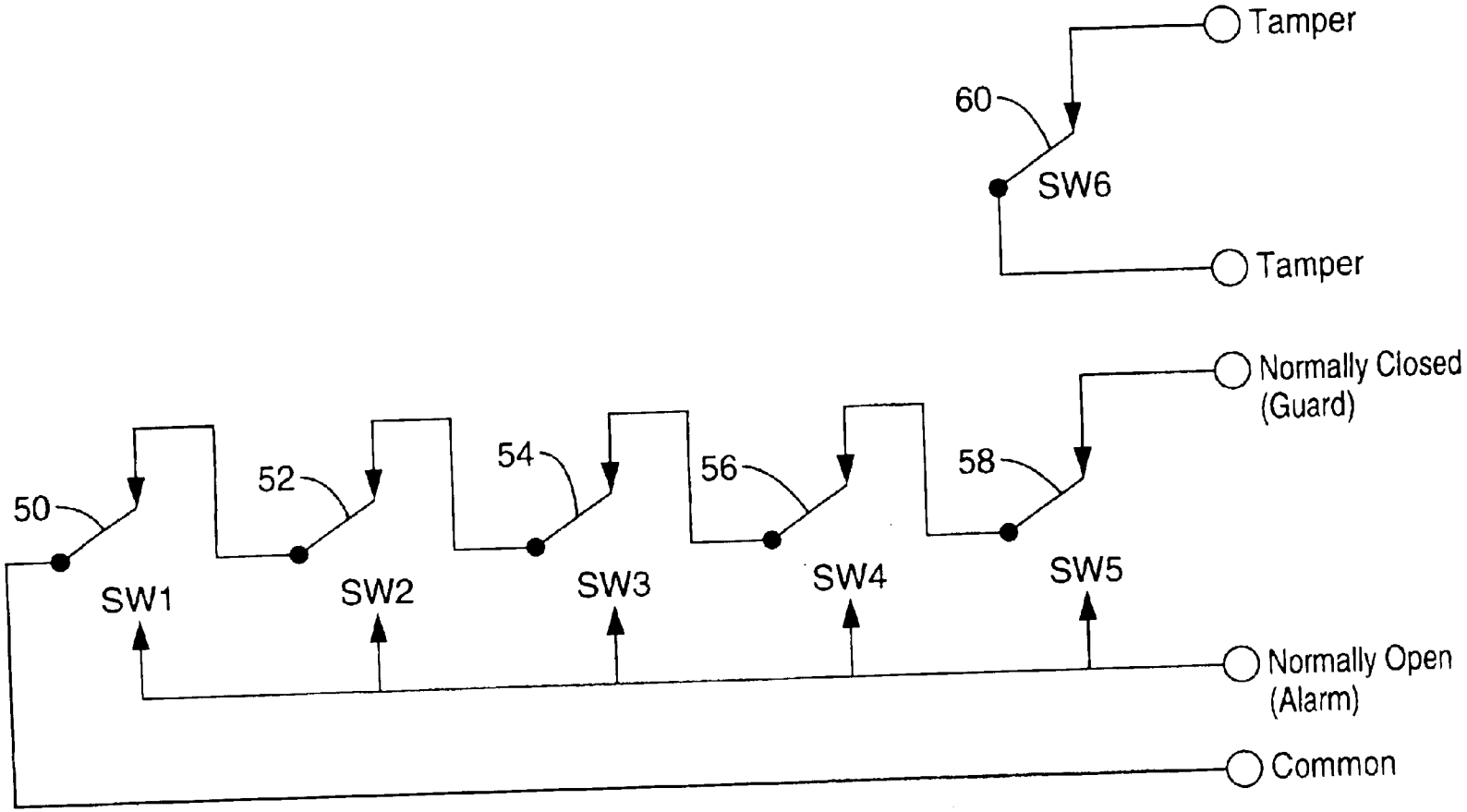
FIG. 8 is a schematic diagram of the sensor unit with the actuator unit and tamper plate in the proper position.
Figure 10:
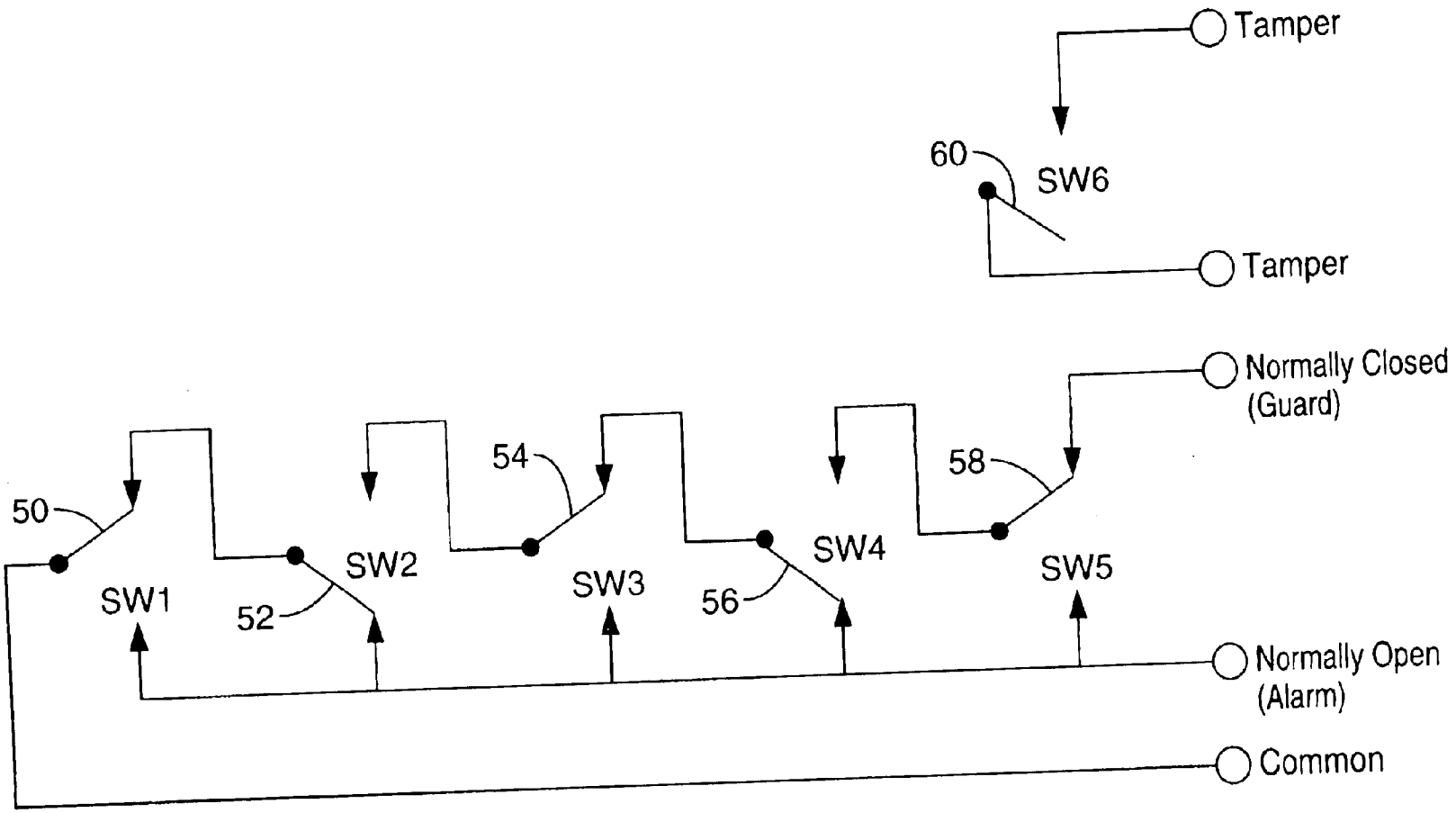
FIG. 10 is a schematic diagram of the sensor unit with the actuator unit and tamper plate out of the proper position.

Further details of sensor unit 12 may be seen with reference to FIG. 7 through FIG. 10. The state of the sensor unit 12 when the tamper plate 20 and actuation unit 14 are in the proper position is shown in FIG. 7 and FIG. 8. In contrast, FIG. 10 shows the state of the sensor unit when the tamper plate 20 and actuation unit 14 are out of position.

Printed circuit board 44 carries an array of printed circuit conductors that are connected to the conductors of cable 46 and on which are mounted five magnetically actuated reed switches 50, 52, 54, 56, 58 and optionally one tamper reed switch 60. Each reed switch 50, 52, 54, 56 and 58 is preferably of the single-pole-double-throw (SPDT) type and has a common terminal, a normally closed contact terminal, and a normally open contact terminal as shown in FIGS. 8 and 10. In addition, reed switch 60 is preferably of the single-pole-single throw (SPST) variety having a normally open contact.

Turning now to FIG. 7, it can be seen that when the actuation unit 14 and tamper magnet 28 are in the proper position, the logic circuit is complete on the normally closed (guard) loop. Magnets 66 and 68 of the actuator unit 14 activate only two reed switches 52 and 56. The gap 16 between the sensor unit 12 and the actuator unit 14 is preferably between approximately 0.2 inches and approximately 0.6 inches.

Each magnet 66, 68 of the actuator unit 14 are magnetized in the axial direction, and are preferably positioned in the same magnetic orientation opposite reed switches 52 and 56. Consequently the magnetic fields of magnets 66, 68 oppose each other in the region centered between them so that the net flux is zero in that region and the center reed switch 54 is not affected. Furthermore, the magnetic flux field generated from magnets 66 and 68 does not extend to reed switches 50 and 58 and these switches are therefore not affected since they exist in a region of lower magnetic flux.

The circuit of FIG. 8 shows the reed switches 50, 52, 54, 56 and 58 in the guard or secure position (e.g. when actuator unit 12 is properly spaced from sensor unit 10). When the sensor unit 10 and tamper plate 20 are properly installed on a door frame, for example, and the door to which the actuator unit 12 is attached is in a closed position, magnets 66 and 68 actuate reed switches 52 and 56, respectively, closing normally open contacts in switches 52 and 56. Thus, the closed contacts of switches 52 and 56 and the normally closed contacts of switches 50, 54 and 58 form a series circuit in a closed guard loop in the presence of the actuator unit 14.

Similarly, the normally open reed switch 60 of the optional tamper circuit is closed in the presence of magnet 28 of the tamper plate 20. The system is in the armed state in the embodiment shown when the tamper and actuator magnets are in the proper position.

Turning now to FIG. 9 and FIG. 10, the removal of the actuator 14 or other alteration of the magnetic field around any of the reed switches 50, 52, 54, 56, 58 causing the activation state of a reed switch to change, the normally closed loop will be broken and the normally open alarm loop will be closed. For example, as seen in FIG. 10, an intruder opening the door would remove the magnetic fields of magnets 66 and 68 of the actuator 14 thereby causing normally open switches 52 and 56 to open and completing the normally open alarm loop circuit.

Likewise, if an attempt is made to defeat the sensor unit 12 by using one or more strong magnets at points along the housing, one or more of the reed switches will change state.

By creating a logic circuit comprised of a series of reed switches 50, 52, 54, 56, and 58 on a printed circuit board 44, the precise location of reed switches can be maintained without custom tuning efforts. In addition, the magnetic shield 34 prevents magnetic fields from reaching the reed switches 50, 54 and 58 and switches 52 and 56 on all but the intended side of the actuator unit 14. If any of the other reed switches 50, 54 or 58 are activated or if either of the two reed switches 52 and 56 are deactivated, the logic circuit is broken and the alarm circuit is triggered.

Thus, unlike the prior art "balanced magnetic field" alarm switches, the logic circuit does not need to be fine tuned and will activate the alarm if a stronger magnetic field is introduced at points surrounding the sensor unit 12 or actuator unit 14. The magnetic shield 34 provides protection from compromise from magnetic field exposures above, behind and below the sensor unit 12. The center reed switch 54 protects against single magnet compromise and polarized pack compromise from the front of the sensor unit 16. The aft reed switches 50 and 58 protect against defeat by exposure to large magnetic fields and magnets placed on the sides of the sensor unit.

Accordingly, it will be seen that this invention provides a security system and apparatus for use in a physical security-monitoring environment that is resistant to being defeated by the presence of strong magnetic fields near the apparatus or removal of portions of the apparatus from the point of installation.

Although the description above contains much specificity, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A magnetic contact apparatus for use with an alarm system, comprising:

a sensor unit;

at least five magnetically actuated switches; and a magnetic shield around said switches configured to define an actuation zone;

wherein at least two of said magnetic switches are configured to be actuated to complete a logic circuit when a magnetic actuator is positioned within said actuation zone;

wherein said logic circuit is configured to be broken if either of said at least two switches is deactivated or if any of said other switches are activated.

2. An apparatus as recited in claim 1, wherein said magnetic actuator comprises two permanent magnets having a predetermined magnetic flux density.

3. An apparatus as recited in claim 2, wherein at least one of the at least five switches is positioned between said two magnets, and wherein the magnetic fields of said magnets oppose each other so as to not actuate said switch.

4. An apparatus as recited in claim 3, wherein at least two switches are placed in a position outside the field of predetermined flux density and are not actuated by the field of predetermined flux density.

5. An apparatus as recited in claim 4, wherein three of the at least five switches are spaced in a row along the length of the sensor unit and the switches at each end of the row are actuated when the actuator unit is placed in proximity to the switches, and the middle switch remains in a deactivated state.

6. An apparatus as recited in claim 5, wherein a switch is placed in parallel with the switches at each end of the row and are not actuated when the actuator unit is placed in proximity to the switches.

7. An apparatus as recited in claim 6, wherein either switch placed in parallel with the switch at the end of the row is actuated when a magnetic field in addition to the magnetic field generated by the actuator unit is placed in proximity to the switches.

8. A magnetic contact apparatus for use with an alarm system, comprising:

a logic circuit configured to indicate an alarm condition if a magnetic actuator is moved outside an actuation zone or if a magnetic field from a source other than said magnetic actuator is brought into said actuation zone after said magnetic actuator is brought into said actuation zone;

wherein said logic circuit comprises:

at least five magnetically actuated switches; and a magnetic shield around said switches configured to define said actuation zone;

wherein at least two of said magnetic switches are configured to be actuated and complete said logic circuit when said magnetic actuator is positioned within said actuation zone; and wherein said logic circuit is configured to be broken if either of said at least two switches is deactivated or if any of said other switches are activated.

9. An apparatus as recited in claim 8, further comprising a magnetic actuator.

10. An apparatus as recited in claim 9, wherein said magnetic actuator comprises two permanent magnets having a predetermined magnetic flux density.

11. An apparatus as recited in claim 10, wherein at least one of the at least five switches is positioned between said two magnets, and wherein the magnetic fields of said magnets oppose each other so as to not actuate said switch.

12. An apparatus as recited in claim 11, wherein at least two switches are placed in a position outside the field of predetermined flux density and are not actuated by the field of predetermined flux density.

13. An apparatus as recited in claim 12, wherein three of the at least five switches are spaced in a row along the length of the sensor unit and the switches at each end of the row are actuated when the actuator unit is placed in proximity to the switches, and the middle switch remains in a deactivated state.

14. An apparatus as recited in claim 13, wherein a switch is placed in parallel with the switches at each end of the row and are not actuated when the actuator unit is placed in proximity to the switches.

15. An apparatus as recited in claim 14, wherein either switch placed in parallel with the switch at the end of the row is actuated when a magnetic field in addition to the magnetic field generated by the actuator unit is placed in proximity to the switches.

16. A magnetic contact apparatus for use with an alarm system, comprising:

a logic circuit;

said logic circuit comprising at least five magnetically actuated switches;

a shield around said switches configured to prevent magnetic fields from outside an activation zone from reaching said switches;

at least two of said magnetic switches configured to be actuated and complete said logic circuit when a magnetic field is within said activation zone;

said logic circuit further configured to be broken if either of said at least two switches is deactivated or if any of said other switches are activated;

wherein breaking of said logic circuit is indicative of an alarm condition.

17. An apparatus as recited in claim 16, further comprising a magnetic actuator.

18. An apparatus as recited in claim 17, wherein said magnetic actuator comprises two permanent magnets having a predetermined magnetic flux density.

19. An apparatus as recited in claim 18, wherein at least one of the at least five switches is positioned between said two magnets, and wherein the magnetic fields of said magnets oppose each other so as to not actuate said switch.

20. An apparatus as recited in claim 19, wherein at least two switches are placed in a position outside the field of predetermined flux density and are not actuated by the field of predetermined flux density.

21. An apparatus as recited in claim 20, wherein three of the at least five switches are spaced in a row along the length of the sensor unit and the switches at each end of the row are actuated when the actuator unit is placed in proximity to the switches, and the middle switch remains in a deactivated state.

22. An apparatus as recited in claim 21, wherein a switch is placed in parallel with the switches at each end of the row and are not actuated when the actuator unit is placed in proximity to the switches.

23. An apparatus as recited in claim 22, wherein either switch placed in parallel with the switch at the end of the row is actuated when a magnetic field in addition to the magnetic field generated by the actuator unit is placed in proximity to the switches.

24. A magnetic contact apparatus for use with an alarm system, comprising:

a sensor unit;

said sensor unit comprising a common conductor, an alarm conductor, and a guard conductor and at least five switches;

wherein each of said switches has an activated state and a deactivated state;

wherein at least two of said switches are adapted to be placed in an activated state in response to a magnetic field of predetermined flux density; and wherein an alarm condition is indicated if any one of said at least two switches is deactivated or if any of said other switches is activated after said at least two switches are activated.

25. An apparatus as recited in claim 24, wherein said sensor unit further comprises a logic circuit electrically interconnecting the switches and the common conductor, the alarm conductor and the guard conductor to complete a series circuit between the common conductor and the guard conductor whenever the two of at least five switches are activated by the actuator unit and the remaining switches are in the deactivated condition, and completing a circuit between the common conductor and the alarm conductor whenever any one of the at least two of five switches are deactivated or any one of the remaining switches are activated.

26. An apparatus as recited in claim 24, further comprising two permanent magnets of predetermined magnetic flux density.

27. An apparatus as recited in claim 26, wherein at least one of the at least five switches is positioned between the two magnets, wherein the magnetic fields of said magnets oppose each other so as to not actuate the switch.

28. An apparatus as recited in claim 24, wherein at least two switches are placed in a position outside the field of predetermined flux density and are not actuated by the field of predetermined flux density.

29. An apparatus as recited in claim 24, further comprising a magnetically permeable shield disposed over said switches and configured to define an actuation zone.

30. An apparatus as recited in claim 24, wherein three of the at least five switches are spaced in a row along the length of the sensor unit and the switches at each end of the row are actuated when the actuator unit is placed in proximity to the switches, and the middle switch remains in a deactivated state.

31. An apparatus as recited in claim 30, wherein a switch is placed in parallel with the switches at each end of the row and are not actuated when the actuator unit is placed in proximity to the switches.

32. An apparatus as recited in claim 31, wherein either switch placed in parallel with the switch at the end of the row is actuated when a magnetic field in addition to the magnetic field generated by the actuator unit is placed in proximity to the switches.

33. A tamper resistant magnetic contact apparatus for use with an alarm system, comprising:

a sensor unit;

said sensor unit having at least five electrically interconnected magnetically actuated reed switches in a logic circuit;

said logic circuit configured to activate an alarm; and an actuator unit providing one or more magnetic fields sufficient to activate a plurality of said reed switches when brought into proximity of said sensor unit;

wherein the deactivation of an active switch or the activation of an inactive switch in said sensor unit is indicative of an alarm condition.

34. An apparatus as recited in claim 33, said contact further comprising means for detecting tampering with the sensor unit.

35. An apparatus as recited in claim 34, wherein said means for detecting tampering, comprises:

a tamper plate having a magnet;

a tamper switch associated with said magnet and said plate, said tamper switch exposed to a magnetic field of predetermined flux density; and a tamper circuit electrically coupled with said switch, wherein the tamper switch and tamper circuit are configured to trigger an alarm when said magnetic field associated with said tamper switch is altered.

36. An apparatus as recited in claim 35:

wherein said tamper plate comprises a core section and an outer section;

said core section configured to be mounted to a surface;

said outer section coupled with said sensor unit;

said outer section severable from said core section.

37. An apparatus as recited in claim 36, said tamper plate further comprising a magnetic field shield disposed between the core section of the tamper plate and the mounting surface.

38. An apparatus as recited in claim 33, wherein said sensor unit further comprises a means for shielding said reed switches of said sensor unit from external magnetic fields.

39. A tamper resistant magnetic alarm contact apparatus, comprising:

a sensor unit having a tamper circuit and a logic circuit including electrically interconnected magnetically actuated reed switches;

said tamper circuit and said logic circuit configured to activate an alarm;

an actuator unit providing one or more magnetic fields sufficient to activate a plurality of said reed switches in said logic circuit when brought into proximity of said sensor unit;

wherein the deactivation of an active switch or the activation of an inactive switch in said sensor unit will trigger an alarm; and a tamper plate having a magnet associated with said sensor unit and said tamper circuit;

said sensor unit having a tamper switch associated with said magnet and said plate;

said sensor unit having a tamper circuit electrically coupled with said tamper switch;

wherein the tamper switch and tamper circuit are configured to trigger an alarm when said magnetic field associated with said tamper switch is altered.

40. An apparatus as recited in claim 39, wherein said tamper plate comprises:

a core section and an outer section;

said core section configured to be mounted to a surface;

said outer section coupled with said sensor unit;

said outer section severable from said core section.

41. A tamper resistant magnetic contact apparatus for use with an alarm system, comprising:

a sensor unit;

said sensor unit having at least five electrically interconnected magnetically actuated reed switches in a logic circuit;

said logic circuit configured to activate an alarm;

an actuator unit providing one or more magnetic fields sufficient to activate a plurality of said reed switches when brought into proximity of said sensor unit;

a tamper plate having a magnet, a core section and an outer section;

said core section configured to be mounted to a surface;

said outer section coupled with said sensor unit;

said outer section severable from said core section; end a magnetic field shield disposed between the core section of the tamper plate and the mounting surface;

a tamper switch associated with said magnet and said plate, wherein said tamper switch is exposed to a magnetic field of predetermined flux density from said magnet; and a tamper circuit electrically coupled to said switch, wherein the tamper switch and tamper circuit are configured to trigger an alarm when said magnetic field associated with said tamper switch is altered.

42. An apparatus as recited in claim 41, wherein said sensor unit further comprises a means for shielding said reed switches of said sensor unit from external magnetic fields.

43. An apparatus as recited in claim 41, wherein said actuator unit comprises two permanent magnets of predetermined magnetic flux density.

44. An apparatus as recited in claim 43, wherein at least one of the at least five switches is positioned between the two magnets, wherein the magnetic fields of said magnets oppose each other so as to not actuate the switch.

45. An apparatus as recited in claim 41, wherein at least two switches are placed in a position outside the field of predetermined flux density and are not actuated by the field of predetermined flux density.

46. An apparatus as recited in claim 41, further comprising a magnetically permeable shield disposed over said switches and configured to define an actuation zone.

47. An apparatus as recited in claim 41, wherein three of the at least five switches are spaced in a row along the length of the sensor unit and the switches at each end of the row are actuated when the actuator unit is placed in proximity to the switches, and the middle switch remains in a deactivated state.

48. An apparatus as recited in claim 47, wherein a switch is placed in parallel with the switches at each end of the row and are not actuated when the actuator unit is placed in proximity to the switches.

49. An apparatus as recited in claim 48, wherein either switch placed in parallel with the switch at the end of the row is actuated when a magnetic field in addition to the magnetic field generated by the actuator unit is placed in proximity to the switches.

* * * * *